US006224468B1

(12) United States Patent
Blume et al.

(10) Patent No.: US 6,224,468 B1
(45) Date of Patent: May 1, 2001

(54) APPARATUS AND METHOD FOR SHARPENING A DISC BLADE

(75) Inventors: Joseph A. Blume; Lawrence D. Mikulsky; James D. BaDour, Jr.; Larry D. Wierschke; Gary R. Wunderlich, all of Green Bay, WI (US)

(73) Assignee: Paper Converting Machine Company, Green Bay, WI (US)

( * ) Notice: Subject to any disclaimer, the term of this patent is extended or adjusted under 35 U.S.C. 154(b) by 0 days.

(21) Appl. No.: 09/354,077

(22) Filed: Jul. 15, 1999

(51) Int. Cl.[7] ..... B24B 1/00

(52) U.S. Cl. ..... 451/48; 451/293; 451/45

(58) Field of Search ..... 451/48, 45, 192, 451/193, 194, 196, 234, 262, 293

(56) References Cited

U.S. PATENT DOCUMENTS

| | | | | |
|---|---|---|---|---|
| 2,077,689 | * | 4/1937 | Grobstein | 451/293 |
| 2,766,566 | | 10/1956 | Gage . | |
| 2,879,533 | | 3/1959 | Gage . | |
| 3,896,591 | * | 7/1975 | Ruble | 51/126 |
| 4,041,813 | | 8/1977 | Spencer . | |
| 4,173,846 | | 11/1979 | Steiner et al. . | |
| 4,182,615 | * | 1/1980 | Weissman | 51/125 |
| 4,347,771 | | 9/1982 | Bradley . | |
| 4,584,917 | | 4/1986 | Blom . | |
| 4,716,689 | * | 1/1988 | Friel | 51/285 |
| 4,821,613 | | 4/1989 | Hertel . | |
| 4,845,900 | * | 7/1989 | Suzuki et al. | 51/285 |
| 4,991,503 | | 2/1991 | Morner . | |
| 5,152,203 | | 10/1992 | Wierschke . | |
| 5,209,150 | * | 5/1993 | Arconada Arconada | 83/174 |
| 5,557,997 | | 9/1996 | Wunderlich et al. . | |
| 5,620,359 | * | 4/1997 | Harrison et al. | 451/45 |
| 5,832,829 | | 11/1998 | Kolbe et al. . | |

FOREIGN PATENT DOCUMENTS

| | | |
|---|---|---|
| 3825600 C2 | 8/1990 | (DE) . |
| 4041497 A1 | 6/1992 | (DE) . |
| 19534651 A1 | 3/1997 | (DE) . |

* cited by examiner

*Primary Examiner*—Derris H. Banks
*Assistant Examiner*—Hadi Shakeri

(57) ABSTRACT

An apparatus and method for sharpening a disc blade includes a grinding wheel mounted on a housing. The housing is mounted on a drive shaft so that the housing rotates with the drive shaft but can move axially relative to the drive shaft. A transversely extending projection on the housing extends into a space between two axially spaced spacers on the drive shaft. A spring is positioned between each spacer and the projection for resiliently biasing the housing in an axial direction.

7 Claims, 5 Drawing Sheets

APPARATUS AND METHOD FOR SHARPENING A DISC BLADE

BACKGROUND OF THE INVENTION

This invention relates to an apparatus and method for sharpening disc blades, and, more particularly, disc blades of saws that transversely sever multi-ply material such as logs of bathroom tissue and kitchen towels and bolts of folded facial tissue and toweling.

Some of the first saws were the so-called "Gilbertville" saws, as described in U.S. Pat. Nos. 2,766,566 and 2,879,633. Those patents taught the use of air cylinder actuated grinder assemblies, with non-driven (idling) and driven grinding wheels, respectively. Although the air cylinder can be considered a spring, because of the force used to move and then load the grinding wheel against the blade and the need for a support on the opposite side of the blade, the grinding wheel was actually held rigidly against the blade.

As saw speeds increased to keep up with production increases, saw improvements were made as taught in co-owned U.S. Pat. Nos. 4,041,813, 4,173,846, 4,347,771, 4,584,917, 4,821,613, and 5,152,203. The '813, '846, 917, and '203 patents teach the use of air cylinder actuated grinder assemblies and loading the assembly against a fixed stop, thereby loading the grinding wheel onto the blade. The '813 patent also teaches driven grinding wheels, in place of idling wheels. The '771 patent teaches the use of light spring pressure, no stop, plus idling grinding wheels for blade sharpening and reduced blade scalloping. This was an improvement to the system as taught in the '813 patent. The '613 patent adds the teaching of blade speed oscillation to the teachings of '771 to reduce blade scalloping. It is noted that a blade is considered scalloped when the outside diameter is no longer a circle, but begins to look like a series of flats around the blade.

With the increased use of recycled substrates for the web and core board, plus wider webs and higher production speeds, saw demands have increased further. Present saws must deal with more impurities in the web, cut faster, and cut through more lanes of product with each pass. This increases the demand on the grinding wheels to keep the blade sharp, without causing or increasing unwanted blade scalloping. As this demand has increased, so has the need for the saw adjuster to set the relationship of the grinding wheels to the blade more consistently. The need for a more consistent grinding process, plus higher quality blades and grinding wheels has also grown.

A problem with idling grinding wheel assemblies is that the grinding process is not as controlled because each grinding wheel grinds at its own rate based on its rotational speed. The grinding wheel rotational speed is a function of the grinding wheel to blade overlap and pressure setting, the friction in the assembly, component manufacturing tolerances, component wear, and contamination as a result of the product cutting and blade sharpening processes.

When the grinding wheel assembly is loaded against a fixed stop, the blade conforms to the grinding wheel. As the blade flatness run out increases, the grinding force between the blade and grinding wheel changes as the blade rotates. Grinding wheel flatness runout can also add to this grinding force variation. These factors, along with the requirement of more aggressive grinding, can lead to blade scalloping, which can increase the grinding force variation even further. Blade scalloping can be compared to washboard on a dirt road, with the vehicle tires representing the grinding wheels. When the scalloping becomes pronounced enough, the blade must be replaced, as sharpening is no longer feasible.

SUMMARY OF THE INVENTION

The invention provides a grinder assembly with driven floating grinding wheels for sharpening blades on saws with single or multiple blades. The grinder assembly makes use of the typical actuation mechanism to bring the grinding wheels into contact with the blade. The grinding wheels are driven for control of the rate of grinding and float in the axial direction to minimize the grinding force variation. Axial movement of the grinding wheel allows the grinding wheel to conform to variations in the blade surface and reduces the precision at which the saw adjuster must set the grinding wheel to the blade. The rate of grinding is controlled by controlling the relative speed between the grinding wheel and the blade at the start of and during sharpening.

DESCRIPTION OF THE DRAWINGS

The invention will be explained in conjunction with an illustrative embodiment shown in the accompanying drawing, in which.

DESCRIPTION OF SPECIFIC EMBODIMENT

Figure 1:
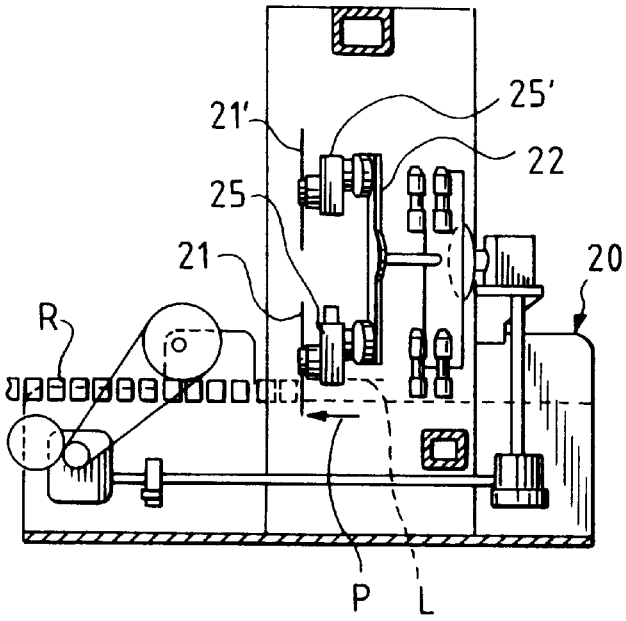
FIG. 1 PRIOR ART
FIG. 1 is a schematic side elevational view of prior art transverse cutting apparatus constructed in accordance with U.S. Pat. No. 4,041,813.
Figure 2:
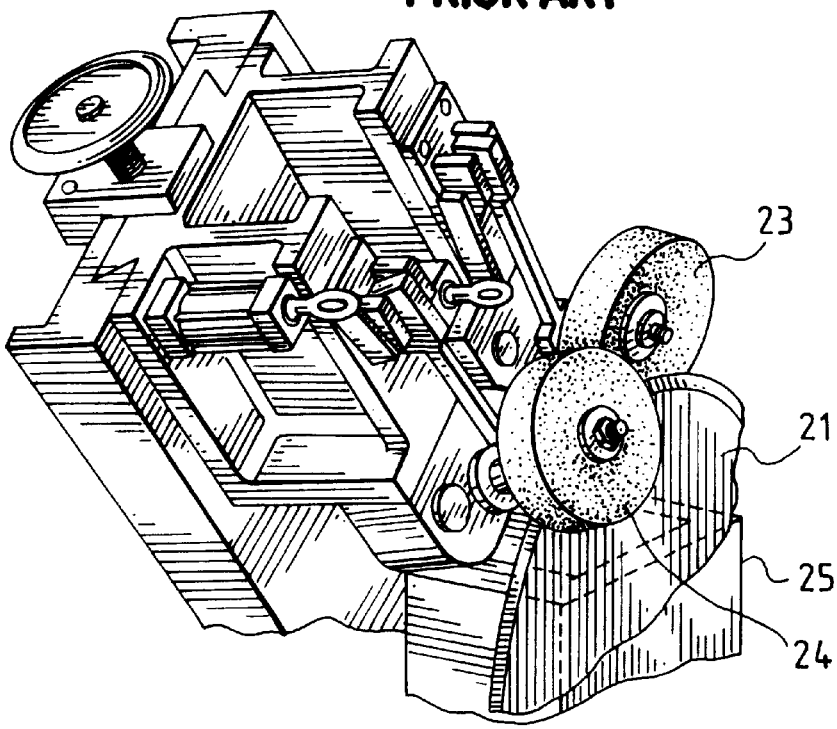
FIG. 2 PRIOR ART
FIG. 2 is a fragmentary perspective view of a portion of the sharpening means of FIG. 1.

To simplify the description of the invention, reference is made to FIGS. 1 and 2 which are representative of the prior art, notably U.S. Pat. No. 4,041,813. This showing is for a log saw such as is employed in the production of retail size rolls of bathroom tissue and kitchen toweling. The log saw includes a frame generally designated 20 through which a log L is advanced along a path P and transversely severed into retail size rolls R. For this purpose, a pair of disc blades 21, 21' are moved in a planetary fashion by virtue of being mounted on a planetary arm 22.

FIG. 2 illustrates a pair of sharpening or grinding stones or wheels 23 and 24 for the disc blade 21. Since this invention is concerned with the structure and operation of the grinding wheels, details of the planetary drive and the remainder of the apparatus of FIG. 1 are omitted. For such details, reference should be made to U.S. Pat. No. 4,041,813.

It will be noted that each of the disc blades 21, 21' is rotatably mounted on a subframe 25, 25' on each end of the planetary arm 22. The grinding wheels of the inventive apparatus are also mounted on a subframe 25 so that the grinding wheels orbit with the blade.

Figure 3:
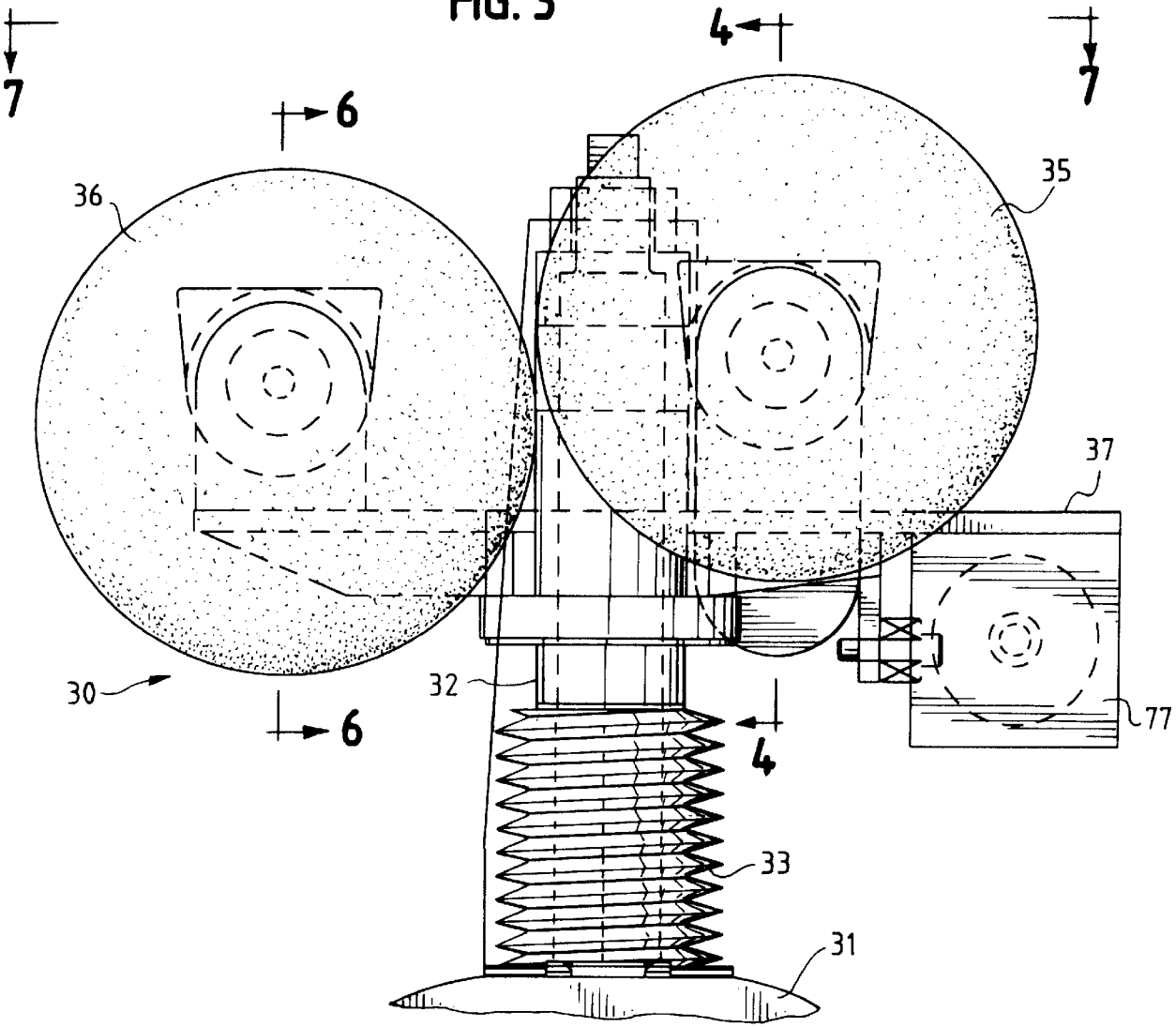
FIG. 3 is a front elevational view of a sharpening apparatus in accordance with the invention.

Referring now to FIG. 3, a grinding wheel assembly 30 includes a frame 31 which is mounted on a subframe 25. A pivot post 32 includes a threaded portion 33 which is supported by the frame 31.

Figure 4:
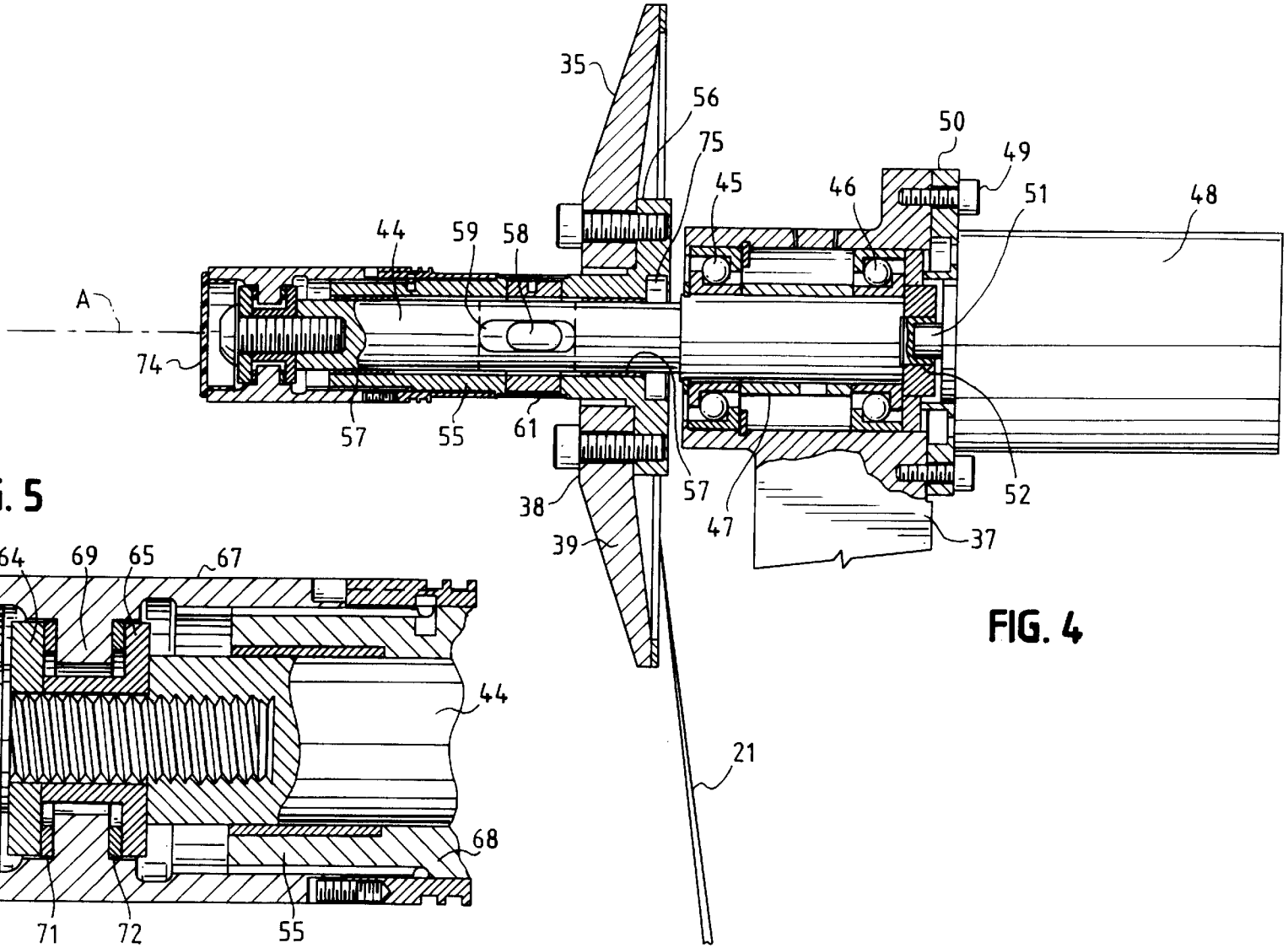
FIG. 4 is a fragmentary sectional view taken along the line 4—4 of FIG. 3.
Figure 6:
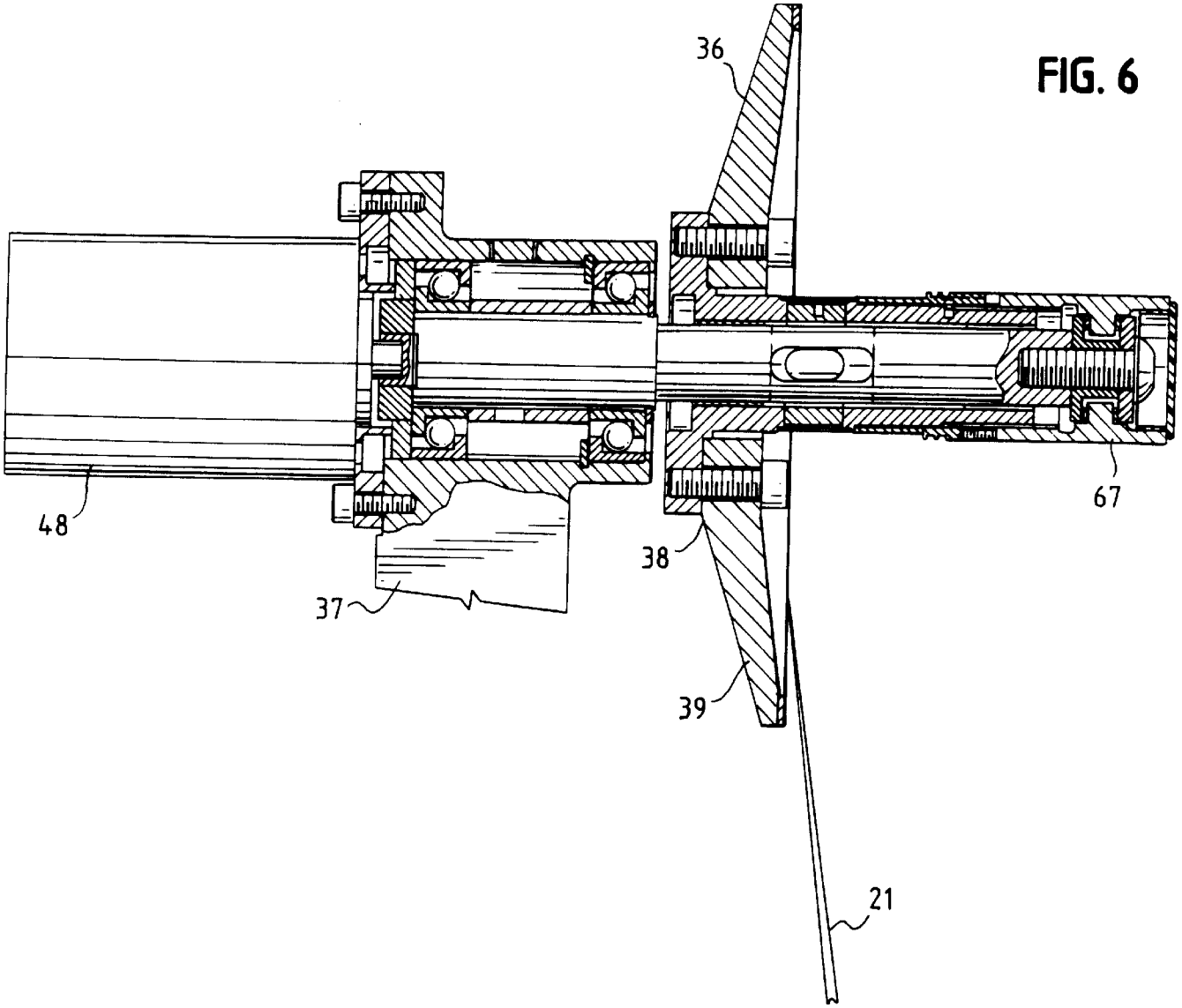
FIG. 6 is a fragmentary sectional view taken along the line 6—6 of FIG. 3.

A pair of grinding wheels or stones 35 and 36 are rotatably mounted on a support bracket 37 which is pivotally mounted on the pivot post 32. Referring to FIGS. 4 and 6, each of the grinding wheels is somewhat saucer-shaped and includes a hub 38 and a frusto-conical body 39. The front grinding wheel 35 is engageable with the front surface of disc blade 21. The rear grinding wheel 36 is engageable with the rear surface of the disc blade.

U.S. Pat. No. 5,152,203 describes the manner in which the support bracket 37 is pivoted on the pivot post 32 to bring the grinding wheels into contact with the blade during the sharpening portion of the cycle of the saw. The '203 patent also describes how the pivot post is rotated relative to the frame 31 to lower the grinding wheels in order to adjust for reduction in the diameter of the blade.

Referring to FIG. 4, a drive shaft 44 for each of the grinding wheels is rotatably mounted in the support bracket 37 by bearings 45 and 46 for rotation about an axis A. The bearings are separated by a cylindrical spacer 47.

The drive shaft is driven by a motor 48 which is connected by bolts 49 to the support bracket 37. A spacer 50 is positioned between the bracket and the motor. A stub drive shaft 51 of the motor extends into slot 52 in the right end of the drive shaft 44 for rotating the drive shaft.

In the particular embodiment illustrated, the motor 48 is a hydraulic motor. However, the motor could also be electric or pneumatic. Alternatively, the drive shaft 44 could be driven by mechanical means, for example, a drive belt and pulleys, gears, or by a combination of various drive means.

A generally cylindrical housing 55 surrounds the left end of the drive shaft 44. The hub 38 of the grinding wheel 35 is bolted to a radial flange 56 on the housing 55. The housing is mounted for axial movement on the drive shaft by a pair of bearings 57. The housing rotates with the drive shaft by virtue of a transverse key 58 which extends radially through the drive shaft and into axially elongated slots 59 in the housing. The axial dimension of the slots is greater than the axial dimension of the key, thereby allowing axial movement of the housing relative to the drive shaft. A cover 61 on the housing holds the key 58 in place and keeps contaminants out of the slots.

Figure 5:
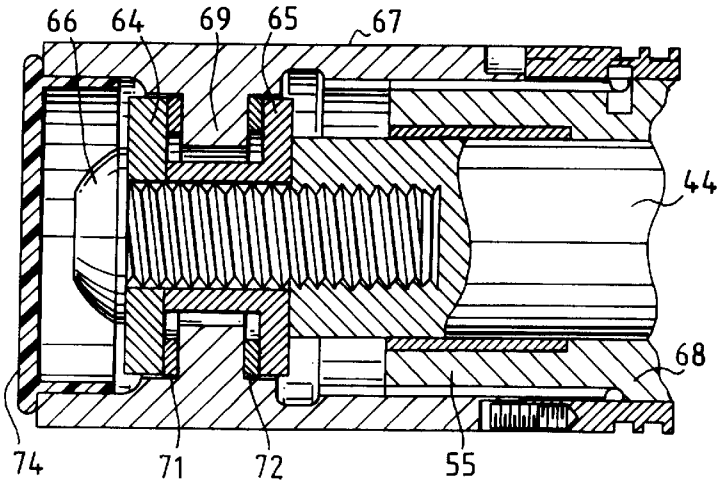
FIG. 5 is an enlarged fragmentary sectional view of a portion of FIG. 4.

Referring to FIG. 5, a pair of radially extending spacers or shoulders 64 and 65 are secured to the left end of the drive shaft 44 by a bolt 66. The housing 55 includes a sleeve 67 which is threadably connected to a cylindrical portion 68 of the housing 55. The sleeve includes a radially inwardly extending projection 69 which extends into the space between the two spacers 64 and 65. A pair of wave springs 71 and 72 are compressed between the projection 69 and the spacers 64 and 65, respectively. The wave spring 71 resiliently biases the projection 69 and the housing 55 to the right, and the wave spring 72 resiliently biases the projection and the housing to the left.

A plug 74 is inserted into the open end of the sleeve 67 to keep contaminants out of the bearings and the space between the housing and the drive shaft. The other end of the housing is closed by a seal 75 (FIG. 4).

When the grinding wheels are not engaging the blade, equalization of the forces provided by the springs 71 and 72 maintain the projection 69 midway between the spacers 64 and 65. The position of the projection 69 sets the axial position of the housing 55 and thus the grinding wheel 35 with respect to the drive shaft 44.

The sleeve 67 and projection 69 act as a depth gauge to adjust the interference or pressure between the grinding wheels and the blade. As the sleeve 67 is rotated relative to the housing 55, the threaded connection between the sleeve and the housing will cause the housing and the grinding wheel to move toward or away from the blade.

Figure 7:
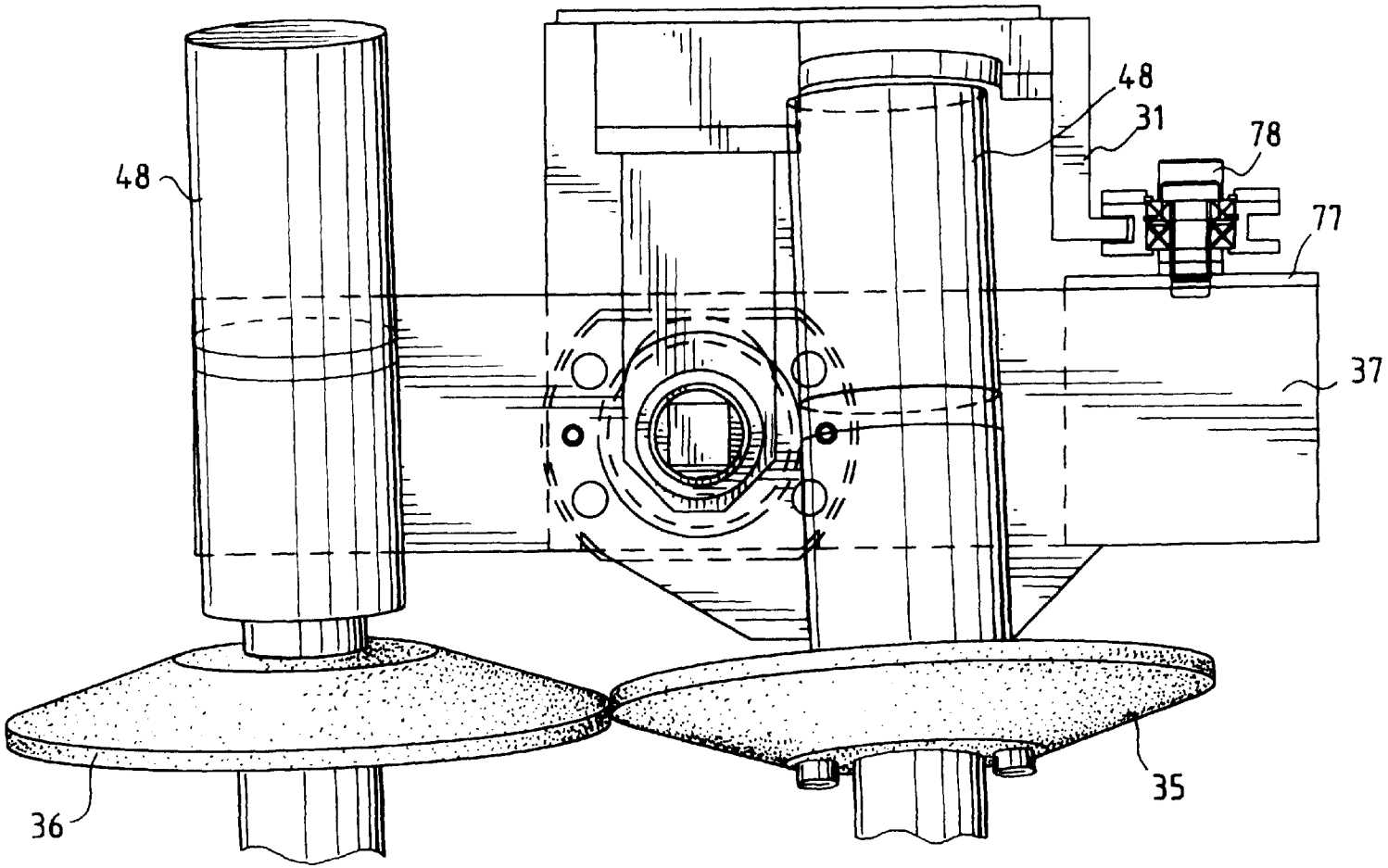
FIG. 7 is a top plan view taken along the line 7—7 of FIG. 3.

A pneumatic actuator 77 (FIGS. 3 and 7) mounted on the support bracket 37 pivots the support bracket on the pivot post 32 when the blade is to be sharpened. The actuator includes a piston 78 (FIG. 7) which is connected to the frame 31. When the piston is retracted by the actuator, the support bracket 37 pivots relative to the frame. Pivoting movement of the support bracket 37 brings the grinding wheels 35 and 36 into contact with the blade 21.

The wave springs 71 and 72 which engage the projection 69 permit each of the housings 55 and the grinding wheels to "float" axially on the drive shaft 44. As variations in the blade causes the position of the outer edge of the blade to change as the blade rotates, the grinding wheels move to maintain the grinding force substantially constant.

While in the foregoing specification a detailed description of the specific embodiment of the invention was set forth for the purpose of illustration, it will be understood that many of the details hereingiven can be varied considerably by those skilled in the art without departing from the spirit and scope of the invention.

We claim:

1. Apparatus for sharpening a disc blade comprising:

a support bracket adapted to be mounted adjacent a disc blade, a drive shaft having an axis, rotatably mounted on the support bracket for rotation about said axis, a housing mounted on the drive shaft for rotation therewith, the housing being mounted on the drive shaft for relative axial movement, a grinding wheel mounted on the housing, and a first spring engaging the housing and the drive shaft, whereby the spring resiliently biases the housing and the grinding wheel in a first axial direction on the drive shaft, and a second spring engaging the housing and the drive shaft, whereby the second spring resiliently biases the housing and the grinding wheel in a second axial direction on the drive shaft.

2. Apparatus for sharpening a disc blade comprising:

a support bracket adapted to be mounted adjacent a disc blade, a drive shaft having an axis, rotatable mounted on the support bracket for rotation about said axis, a housing mounted on the drive shaft for rotation therewith, the housing being mounted on the drive shaft for relative axial movement, a grinding wheel mounted on the housing, and a spring engaging the housing and the drive shaft, whereby the spring resiliently biases the housing and the grinding wheel in a first axial direction on the drive shaft, and a transversely extending key on the drive shaft, the key extending through a slot in the housing, the axial dimension of the slot being greater than the axial dimension of the key whereby the key causes the housing to rotate with the drive shaft and permits relative axial movement between the housing and the drive shaft.

3. Apparatus for sharpening a disc blade comprising:

a support bracket adapted to be mounted adjacent a disc blade, a drive shaft having an axis, rotatable mounted on the support bracket for rotation about said axis, a housing mounted on the drive shaft for rotation therewith, the housing being mounted on the drive shaft for relative axial movement, a grinding wheel mounted on the housing, and a spring engaging the housing and the drive shaft, whereby the spring resiliently biases the housing and the grinding wheel in a first axial direction on the drive shaft, and a pair of axially spaced spacers mounted on the drive shaft and a projection on the housing which extends into the space between the spacers, said spring being positioned between the projection and one of the spacers.

4. The apparatus of claim 3 including a second spring positioned between the projection and the other spacer.

5. The apparatus of claim 3 in which the housing includes a first portion on which the grinding wheel is mounted and a second portion which is threadedly engaged with the first portion whereby the relative axial positions of the first and second portions of the housing can be adjusted, said projection being on the second portion of the housing.

6. The apparatus of claim 1 including means for rotating the drive shaft.

7. A method of sharpening a rotating disc blade comprising the steps of:

mounting a grinding wheel on a housing, rotatably driving the housing and the grinding wheel to rotate about an axis of rotation, moving the housing and the grinding wheel so that the grinding wheel engages the rotating disc blade while allowing the housing and the grinding wheel to move axially with respect to said axis of rotation, and resiliently biasing the housing in opposite axial directions relative to said axis of rotation.

* * * * *